US007823346B2

(12) United States Patent
Lang

(10) Patent No.: US 7,823,346 B2
(45) Date of Patent: Nov. 2, 2010

(54) CURTAIN-WALL MULLION WITH MOUNTING TONGUE SCREW RACE

(75) Inventor: William J. Lang, Rockwall, TX (US)

(73) Assignee: Oldcastle Glass Engineering Products, Inc., Plano, TX (US)

( * ) Notice: Subject to any disclaimer, the term of this patent is extended or adjusted under 35 U.S.C. 154(b) by 931 days.

(21) Appl. No.: 11/675,553

(22) Filed: Feb. 15, 2007

(65) Prior Publication Data

US 2007/0199261 A1 Aug. 30, 2007

Related U.S. Application Data

(60) Provisional application No. 60/774,566, filed on Feb. 17, 2006.

(51) Int. Cl.
*E04B 2/88* (2006.01)
*E04B 2/96* (2006.01)

(52) U.S. Cl. ..... 52/235; 52/745.21

(58) Field of Classification Search ..... 52/235, 52/282.4, 282.5, 745.21
See application file for complete search history.

(56) References Cited

U.S. PATENT DOCUMENTS 4,055,923 A 11/1977 Biebuyck
4,506,484 A * 3/1985 Bartlett et al. ..... 52/476
4,644,717 A 2/1987 Biebuyck
4,773,193 A 9/1988 Biebuyck et al.
5,036,637 A 8/1991 Biebuyck
5,058,344 A 10/1991 Biebuyck
5,319,882 A 6/1994 Biebuyck
5,469,665 A 11/1995 Biebuyck
5,592,795 A 1/1997 Rinehart et al.
5,930,955 A 8/1999 Biebuyck
5,930,966 A * 8/1999 Wood et al. ..... 52/364
6,158,182 A 12/2000 Biebuyck
6,226,940 B1 5/2001 Biebuyck et al.
6,715,248 B2 4/2004 Biebuyck
6,993,873 B2 2/2006 Biebuyck et al.

FOREIGN PATENT DOCUMENTS

GB 2133449 1/1984

* cited by examiner

*Primary Examiner*—Robert J Canfield
(74) *Attorney, Agent, or Firm*—Winstead PC

(57) ABSTRACT

A curtain wall system having a mullion mounting tongue screw-race configuration for improving the efficiency and reliability of curtain wall elements assembled thereto. The curtain wall system includes a face, a first leg, and a second leg. The first and second leg are integrally formed with and extend outwardly from the face and are interconnected via an intermediate web section. Each of the first leg and the second leg include an outer screw-race lip and an inner screw-race lip. The inner screw-race lips and the outer screw-race lips are disposed on opposite sides of the intermediate web section to form a screw race. The inner screw-race lips and the outer screw-race lips are spaced apart by a distance affording engagement by a threaded fastener against each of the inner screw-race lips and the outer screw-race lips. A thickness of the intermediate web section is less than a thickness of the first leg and of the second leg.

29 Claims, 3 Drawing Sheets

CURTAIN-WALL MULLION WITH MOUNTING TONGUE SCREW RACE

CROSS REFERENCE TO RELATED APPLICATIONS

This patent application claims priority from, and incorporates by reference the entire disclosure of, U.S. Provisional Patent Application No. 60/774,566, which was filed on Feb. 17, 2006.

BACKGROUND OF THE INVENTION

1. Technical Field

The present invention relates to curtain walls used for building exteriors and, more particularly, but not by way of limitation, to methods of and systems for constructing and assembling curtain walls incorporating mullion mounting tongues having integrally formed screw-race configurations.

2. History of Related Art

The use of curtain walls for building construction is widespread and generally accepted by municipal building standards. They are cost effective and often aesthetically appealing. Curtain walls are typically constructed of extruded aluminum frame support members for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape.

In the assembly of a curtain wall, the vertical and horizontal mullions are first secured to the building superstructure in a "grid" type array. The panels that must be assembled to the grid formed by the vertical and horizontal mullions are likewise assembled thereto and carefully sealed to prevent water infiltration. These panels are often made of glass and are secured in place by pressure plates bearing thereagainst. The pressure plates are assembled to the curtain wall vertical and horizontal mullions after the panels are installed and are therefore attached to the vertical and horizontal mullions by fasteners. Typically these fasteners are threaded members such as screws that secure the pressure plate to an external region, such as a mullion tongue of the curtain wall. This assembly step is generally time intensive and requires skilled manual labor. Moreover, the manual labor generally occurs outwardly of the curtain wall and therefore must be carefully designed to facilitate ease and reliability as well as some degree of accuracy and rapidity in installation. For this reason, numerous mullion tongue screw-race designs have been created over the years for facilitating the installation of threaded fasteners into the curtain-wall mullion. Two examples of prior art curtain wall mounting systems are shown in U.S. Pat. No. 5,592,795 and U.K. Patent Application GB 2 133449A.

Referring now to FIG. 1, there is shown an end elevational cross-sectional view of a curtain-wall mullion of the type having an external tongue adapted for receiving a pressure plate thereagainst and threaded fastener therein and comprising a part of a pressure-plate mounting system. A threaded fastener 122 in this particular application is a screw combining a drill bit tip and contiguous threaded body region that facilitates an assembly process. The threaded fastener 122 can be used with an automatic drill and positioned to both penetrate an otherwise solid surface and secure itself within a hole generated therein. The reliability of the connection with a threaded fastener such as the threaded fastener 122 in a curtain wall is then dependent upon a structural interconnection between an external tongue portion of the curtain-wall mullion and a threaded body portion of the threaded fastener.

Problems associated with the assembly process described above include the time necessary for penetration of a mullion tongue screw-race, as well as any tendency of the threaded fastener to "walk" when initially being driven into the curtain-wall mullion tongue. This may occur with certain screw-race designs. Since the threaded fastener 122 is typically manually aligned and driven by a hand-held drill supported by a skilled laborer outside a vertical curtain wall, the possibility of some screw movement (i.e., "walking") is often tolerated. This means that the most desirable screw position may not be achieved. Secondly, the length of time necessary to penetrate a thick web portion of a screw race of an external mullion tongue further delays the process, decreases project efficiency, increases the possibility of associated errors and/or risks and is more time and labor intensive. The thickness and location of the web portion of a screw race may vary, depending on the design.

For example, referring now to FIG. 3 there is shown yet another prior art embodiment of curtain wall construction wherein another curtain-wall mullion tongue design is utilized for pressure-plate mounting. This particular tongue design incorporates a web portion that is at the lower region of a screw-race yoke and that is not designed to be penetrated at all. The yoke portion of this particular screw race comprises a pair of generally parallel lips that are spaced one from the other to receive a screw at any location therealong. The screw used therewith will penetrate the internal areas of the lips of the screw race to be secured therein but not extend beyond a given dimension that is less than the depth of the screw race. No web portion must be penetrated, which increases the speed of installation. However, the screw threads are only engaged on opposite side surfaces thereof and the pull out strength of the connection is dependent upon the lip engagement. Should the lips expand during loads, the pull out strength can be significantly reduced.

SUMMARY OF INVENTION

A curtain-wall mullion includes a face, a first leg, and a second leg. The first leg and the second leg are integrally formed with and extend outwardly from the face and are interconnected via an intermediate web section. Each of the first leg and the second leg includes an outer screw-race lip and an inner screw-race lip. The inner screw-race lips and the outer screw-race lips are disposed on opposite sides of the intermediate web section to form a screw race. The inner screw-race lips and the outer screw-race lips are spaced apart by a distance affording engagement by a threaded fastener against each of the inner screw-race lips and the outer screw-race lips.

A curtain-wall system includes a curtain-wall mullion that includes a first leg and a second leg interconnected via an intermediate web section. Each of the first leg and the second leg includes an outer screw-race lip and an inner screw-race lip. The curtain-wall system also includes a threaded fastener penetrating the intermediate web section and having threads engaged against each of the inner screw-race lips and the outer screw-race lips and a pressure plate secured relative to the curtain-wall mullion by the threaded fastener.

A curtain-wall mounting method includes penetrating, by a threaded fastener, of a pressure plate to be mounted relative to a curtain-wall mullion, engaging, by the threaded fastener, of a pair of outer screw-race lips of the curtain-wall mullion, penetrating, by the threaded fastener, of an intermediate web section of the curtain-wall mullion, and engaging, by the threaded fastener, of a pair of inner screw-race lips of the curtain-wall mullion.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF ILLUSTRATIVE EMBODIMENT(S) OF THE INVENTION

Figure 1:
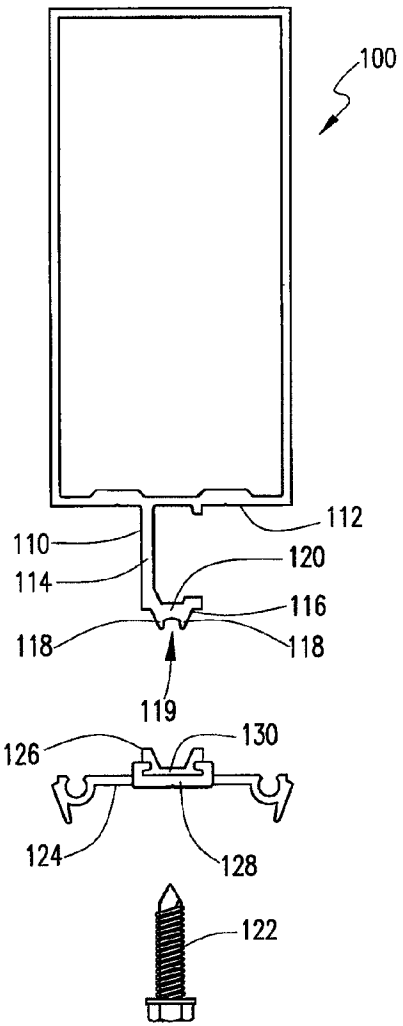
FIG. 1 Prior Art
FIG. 1, previously described in part, is an end elevational, cross-sectional view of a curtain-wall mullion pressure-plate mounting assembly and method illustrating a first screw-race design of an external mounting tongue.

Referring now to FIG. 1, a curtain-wall mullion 100 is shown with an external mounting tongue 110 extending outwardly from an outer face 112 thereof. The external mounting tongue 110 of this particular embodiment of a pressure-plate mounting assembly includes a single leg 114 having a mounting surface 116 extending generally transversely thereacross on a distal end thereof in a position adapted to receive a threaded fastener therethrough. In that regard, a pair of outwardly extending lips 118 of shallow construction are provided outwardly of an intermediate web section 120 to define a screw race 119. A threaded fastener 122 (having a drill bit nose, as described above) is shown disposed outwardly of a pressure plate 124 with a thermal insulator 126 disposed therewith. The threaded fastener 122 is adapted to be rotated by a conventional drilling apparatus such as an electric drill, or the like, to first penetrate the pressure plate 124 in a region of an intermediate body portion 128 as well as an intermediate web section 130 of the thermal insulator 126. With rotation, the threaded fastener 122 then continues into the intermediate web section 120 between the outwardly extending lips 118 to therein extend downwardly therethrough once penetration has been completed to secure the pressure plate 124 and the thermal insulator 126 against the mounting surface 116 of external mounting tongue 110.

The problems associated with FIG. 1, as described above, include the thickness of the intermediate web section 120 which requires valuable time for penetration. Moreover, the length of the outwardly extending lips 118 of the screw race 119 engaging the threaded fastener 122 is minimal therein contributing to a limitation in the pull out force afforded by that particular design. Although capable of supporting pressure plates in a curtain wall assembly, a design issue is the length of time necessary for drilling and penetrating the intermediate web section 120 as well as the reliability and accuracy of the mounting process.

Figure 2:
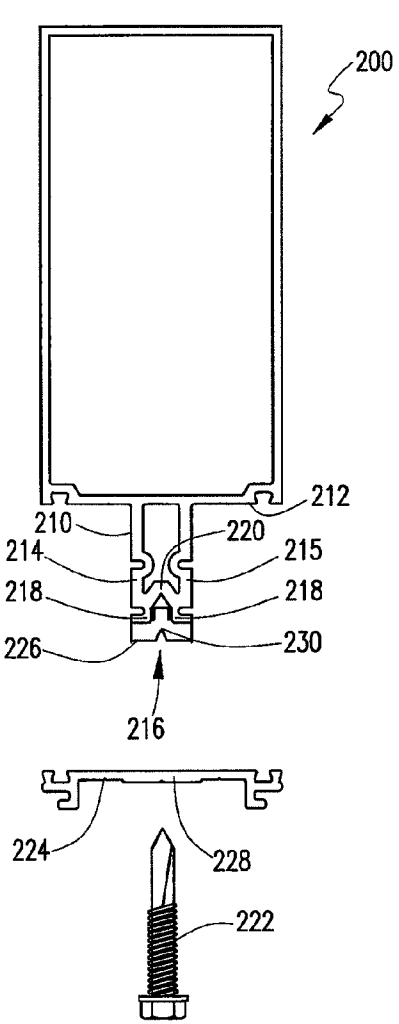
FIG. 2 Prior Art
FIG. 2 is an end elevational, cross-sectional view of another pressure-plate mounting assembly illustrating a second mounting tongue screw-race design.

Referring now to FIG. 2, there is shown an alternative embodiment of the curtain-wall mullion of FIG. 1 and its function as part of a pressure-plate mounting assembly. As shown herein, a curtain-wall mullion 200 is formed with a double-sided tongue 210 extending from a face 212 of the curtain-wall mullion 200. Sidewalls 214 and 215 are provided for support of a generally V-shaped web section 220 disposed thereacross and having lips 218 extending outwardly therefrom to define a screw race 216. The lips 218 are shown to be extruded into the generally V-shaped configuration with enlarged sidewall regions allowing for greater engagement of a threaded fastener extending therethrough and concomitantly greater pull out strength.

Still referring to FIG. 2, a threaded fastener 222, of the drill bit end type described above is shown. The threaded fastener 222 is longer in construction relative to the threaded fastener 122 of FIG. 1. In this particular embodiment, the threaded fastener 222 is adapted for penetrating a pressure plate 224 and thermal insulator 226 (shown in this view in engagement with the double-sided tongue 210). The threaded fastener 222 is adapted to penetrate an intermediate body portion 228 as well as a generally U-shaped groove 230 in the thermal insulator 226 for receipt thereof. The U-shaped groove 230 is of an elongate construction and therein forms a separate screw race that is in generally parallel spaced relationship with the screw race defined by the lips 218 of the double-sided tongue 210. The rotation of the threaded fastener 222 causes penetration of both the pressure plate 224, the thermal insulator 226, and the generally V-shaped, relatively thick, the generally V-shaped web section 220 of the double-sided tongue 210.

Figure 3:
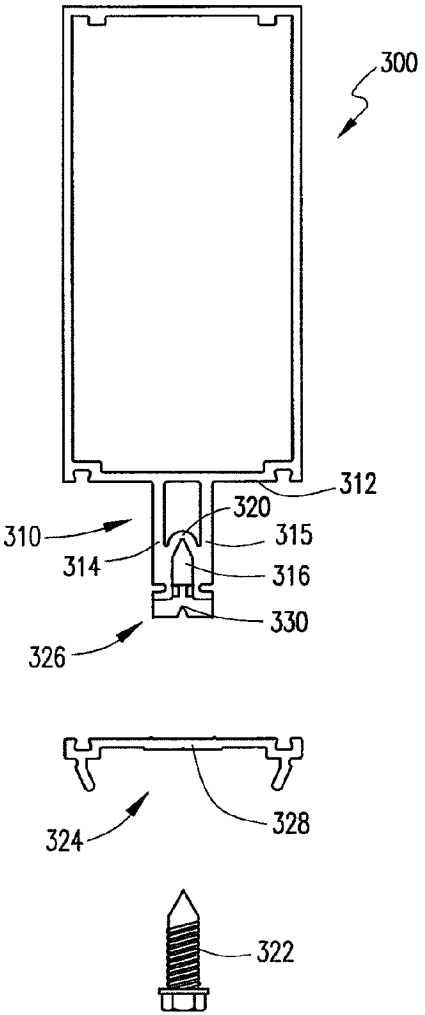
FIG. 3 Prior Art
FIG. 3, previously described in part, is an end elevational, cross-sectional view of yet another pressure-plate mounting assembly illustrating a third mounting tongue screw-race design.

Referring now to FIG. 3, there is shown yet another prior art embodiment of a curtain-wall mullion having an external tongue adapted for the mounting of a pressure plate. In this particular view, curtain-wall mullion 300 is formed with an external mounting tongue 310 extending from a face 312 and having a pair of legs 314 and 315 defining a screw race 316 formed therebetween. The legs 314 and 315 form, in essence, the lips of the screw race 316 with the generally U-shaped bottom portion 320 of relatively thin construction extending therebetween. A thermal insulator 326 is shown mounted to the external mounting tongue 310 and is formed with a groove 330 forming a screw race therein. A pressure plate 324 is formed with an intermediate body portion 328 for receipt of a threaded fastener 322 therethrough in such a manner as to be secured within the screw race 316 of the external mounting tongue 310. While generally effective in securing the pressure plate 324, the length and effectiveness of threaded engagement between the threaded fastener 322 and the sidewalls of the screw race 316 defined by the legs 314 and 315, is both limited and vulnerable to any flexing of the legs 314 and 315, one from the other.

Referring now to FIG. 1, FIG. 2 and FIG. 3 in combination, it should be noted that pull out strength of the threaded fastener depends in large part upon the amount of material engaged by the threads. When the threaded fastener is secured only within a two-sided screw race, the thread engagement occurs within the sidewalls of the race. By definition, this is less than the full circumference of the threads and therefore the depth of the screw race available for thread engagement is critical. Also critical is the ability of the screw race, which typically appears in a generally yoke-shaped configuration, not to bow outwardly, or flex open, under loading conditions.

Obviously, the expansion or opening of the yoke of the screw race, such as that shown in FIG. 3, would result in at least some disengagement of portions of threads within the sidewalls thus reducing effective pull out force and weakening the mounting. It is for this reason that the structural design of the screw race must be carefully considered in such mounting assemblies.

Figure 4:
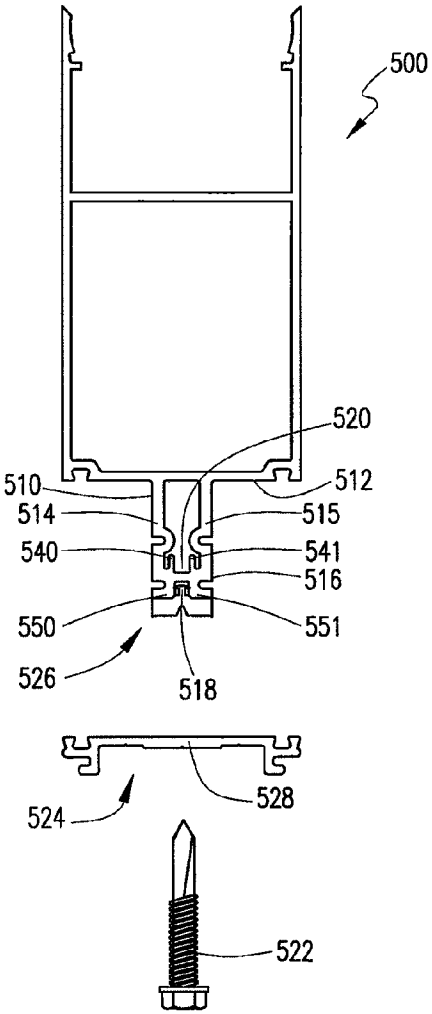
FIG. 4 is an end elevational, cross-sectional view of a curtain-wall mullion pressure-plate mounting assembly including an external mounting tongue constructed in accordance with one embodiment of the principles of the present invention.

Referring now to FIG. 4, there is shown an end elevational cross-sectional view of one embodiment of the present invention. In this particular view, it will be seen that the screw race defined herein comprises a generally H-shaped section of the mounting tongue which provides a combination of structurally reinforced inner and outer screw-race lips as well as an intermediate web affording full thread engagement while being sufficiently thin so as to afford rapidity in the penetration and mounting of the threaded fastener therein. In this manner, both the advantages of a deep screw race and a fully penetrated web are provided in a configuration affording maximum structural integrity relative to flexing of the screw-race walls.

Referring now specifically to FIG. 4, there is shown a curtain-wall mullion 500 having a mounting tongue 510 extending from a face 512 of the curtain-wall mullion 500 to comprise part of a pressure-plate mounting assembly. The tongue is formed by a pair of legs 514 and 515 that form an end 516 adapted for the receipt of a threaded fastener therein. The end 516 is formed with a screw race 518 having an intermediate web section 520 formed thereacross. The screw race 518 is adapted for the receipt of the threaded fastener 522 therein.

Still referring to FIG. 4, the threaded fastener 522 is adapted for penetration of a pressure plate 524 and a thermal insulator 526 shown inserted into the screw race 518. The pressure plate 524 has an intermediate body portion 528 adapted for receipt of the threaded fastener 522 therethrough. The screw race 518 of the mounting tongue 510 is further constructed with a pair of inwardly extending screw-race lips 540 and 541 in generally parallel spaced relationship to the legs 514 and 515 and projecting inwardly from the intermediate web section 520 extending therebetween. The advantage of the generally H-shaped configuration of the end 516 of the mounting tongue 510 will be discussed in more detail below.

Figure 5:
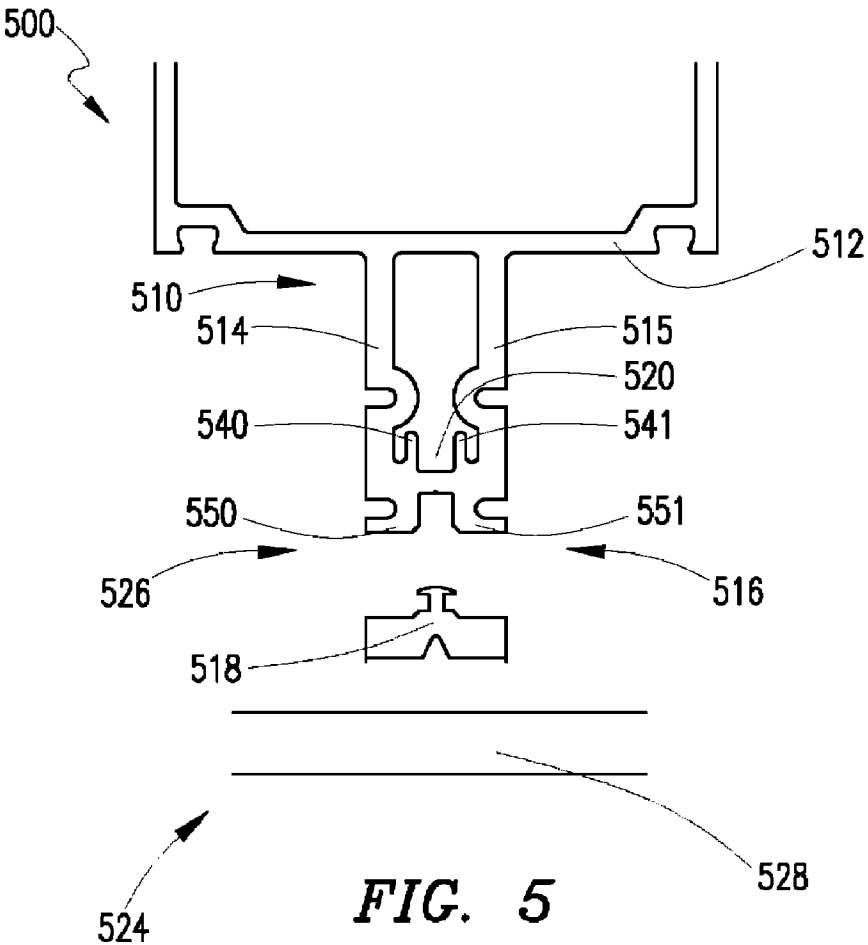
FIG. 5 is an enlarged exploded cross-sectional view of the mounting tongue, the thermal insulator, and the pressure plate of FIG. 4.

Referring now to FIG. 5 there is shown an enlarged exploded cross-sectional view of the mounting tongue 510, the thermal insulator 518, and the pressure plate 524 of FIG. 4. It may be seen that the screw-race lips 540 and 541 projecting inwardly from intermediate web section 520 form a generally H-shaped configuration in conjunction with screw-race lips 550 and 551 projecting outwardly from the intermediate web section 520. It may be seen that the screw-race lips 550 and 551 form outer portions of the legs 514 and 515. The screw race lips 550 and 551 are generally aligned with the screw-race lips 540 and 541 to therein comprise an elongate screw race that is intermediately supported by the intermediate web section 520 and the material extruded therearound. It may also be seen that the intermediate web section 520 creates structural support for the screw race 518 in such a way as to minimize any deflection thereof as described above. Additionally, the material of the intermediate web section 520 in combination with the screw-race lips 540 and 541 adds additional surface area for thread engagement by the threaded fastener 522 extending therethrough. The rate of penetration of the web area by the threaded fastener 522 is, however, facilitated by the relative thin (e.g., 0.094") extrusion of the intermediate web section 520 relative to the web sections 130 and 220 seen in FIG. 1 and FIG. 2. Although the intermediate web section 520 itself is relatively thin to facilitate rapid penetration, for example, by the threaded fastener 522, the extruded body portion of the mounting tongue 510 extending outwardly therefrom and in the generally H-shaped configuration specified herein creates a structurally enhanced screw race with advantages not heretofore seen in prior art embodiments.

In operation, the continuous non-threaded screw race as set forth and shown above has the advantages of fast and reliable installation with standard fastening hardware. The assembly has improved pull out strength with a reliable screw-race structure that effectively facilitates a constant pull out force. Because of the above, the present invention affords constant gasket compression from the pressure plate applied to the curtain wall.

Figure 6:
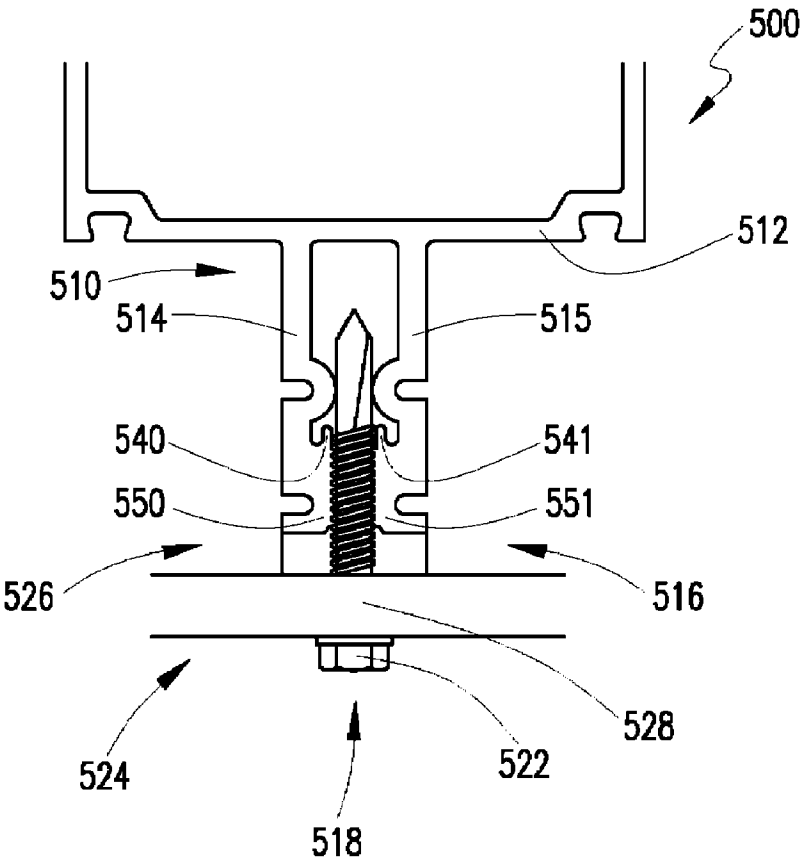
FIG. 6 is an enlarged cross-sectional partial view of the curtain-wall mullion of FIG. 4 illustrating receipt of a threaded fastener therein securing a pressure plate thereacross in accordance with principles of the present invention.

FIG. 6 is an enlarged partial cross-sectional view of the curtain-wall mullion 500 illustrating receipt of the threaded fastener 522 therein securing the pressure plate 524 thereacross. Those having skill in the art will appreciate that, in a typical embodiment, the threaded fastener 522 and the mounting tongue 510 are relatively dimensioned so that, along a direction of travel of the threaded fastener 522, a leading, unthreaded, edge of the threaded fastener 522 begins to contact the intermediate web section 520 before a leading thread of the threaded fastener 522 begins to contact the thermal insulator 526. Moreover, in a typical embodiment, the depth of the screw race 518 bounded by a trailing edge of the screw-race lips 540 and 541 extends beyond the leading thread of the threaded fastener 522 when the threads of the threaded fastener 522 are engaged along their entire length within the screw race 518 (e.g., when a head of the threaded fastener 522 contacts the pressure plate 524) in order to ensure maximal screw-race thread engagement by the threaded fastener 522. In addition, in a typical embodiment, the leading, unthreaded, edge of the threaded fastener 522 does not contact the face 512 when the threaded fastener 522 is fully engaged within the screw race 518.

Notwithstanding the above, those having skill in the art will appreciate that a threaded fastener may be used that has a leading (threaded or unthreaded) edge that does not begin to contact the intermediate web section 520 before a leading thread of the threaded fastener 522 begins to contact the thermal insulator 526 without departing from principles of the invention. Those having skill in the art will also appreciate that the depth of the screw race 518 bounded by a trailing edge of the screw-race lips 540 and 541 need not necessarily extend beyond the leading thread of the threaded fastener 522 when a head of the threaded fastener 522 contacts the pressure plate 524 and that a leading (threaded or unthreaded) edge of the threaded fastener 522 may in some embodiments contact the face 512 when the threaded fastener 522 is fully engaged within the screw race 518.

It is thus believed that the operation and construction of the present invention will be apparent from the foregoing description. While the method and apparatus shown or described have been characterized as being preferred, it will be obvious that various changes and modifications may be made therein without departing from the spirit and scope of the invention.

What is claimed is:

1. A curtain-wall mullion comprising:

a face;

a first leg and a second leg integrally formed with and extending outwardly from the face and interconnected via an intermediate web section, each of the first leg and the second leg comprising:

an outer screw-race lip; and an inner screw-race lip;

wherein the inner screw-race lips and the outer screw-race lips are disposed on opposite sides of the intermediate web section to form a screw race; and wherein the inner screw-race lips and the outer screw-race lips are spaced apart by a distance affording engagement by a threaded fastener against each of the inner screw-race lips and the outer screw-race lips;

wherein a thickness of the intermediate web section is less than a thickness of the first leg and of the second leg.

2. The curtain-wall mullion of claim 1, wherein the intermediate web section extends generally orthogonally between the first leg and the second leg.

3. The curtain-wall mullion of claim 1, wherein the inner screw-race lips are generally parallel to one another.

4. The curtain-wall mullion of claim 1, wherein the outer screw-race lips are generally parallel to one another.

5. The curtain-wall mullion of claim 1, wherein:

the inner screw-race lips are generally parallel to one another; and the outer screw-race lips are generally parallel to one another.

6. The curtain-wall mullion of claim 1, wherein all of the inner screw-race lips and the outer screw-race lips are generally parallel to one another.

7. The curtain-wall mullion of claim 1, wherein, in a fully-engaged state, the threaded fastener penetrates the intermediate web section and mounts the thermal insulator between the pressure plate and the curtain-wall mullion.

8. The curtain-wall mullion of claim 1, wherein the screw race is generally H-shaped.

9. The curtain-wall mullion of claim 1, wherein the inner screw-race lips and the outer screw-race lips are generally parallel to a direction of travel of the threaded fastener during progressive engagement of the threaded fastener with the curtain-wall mullion.

10. The curtain-wall mullion of claim 1, wherein the curtain-wall mullion comprises a material having a tensile strength of aluminum.

11. The curtain-wall mullion of claim 1, wherein the curtain-wall mullion consists essentially of aluminum.

12. The curtain-wall mullion of claim 1, wherein the curtain-wall mullion comprises aluminum.

13. A curtain-wall system comprising:

a curtain-wall mullion comprising a first leg and a second leg interconnected via an intermediate web section, each of the first leg and the second leg comprising an outer screw-race lip and an inner screw-race lip;

a threaded fastener penetrating the intermediate web section and having threads engaged against each of the inner screw-race lips and the outer screw-race lips; and a pressure plate secured relative to the curtain-wall mullion by the threaded fastener.

14. The curtain-wall system of claim 13, comprising a thermal insulator interposed between the curtain-wall mullion and the pressure plate.

15. The curtain-wall system of claim 13, wherein the curtain-wall mullion comprises a face, the first leg and a second leg being integrally formed with and extending outwardly from the face.

16. The curtain-wall system of claim 13, wherein the intermediate web section extends generally orthogonally between the first leg and the second leg.

17. The curtain-wall system of claim 13, wherein the inner screw-race lips are generally parallel to one another.

18. The curtain-wall system of claim 13, wherein the outer screw-race lips are generally parallel to one another.

19. The curtain-wall system of claim 13, wherein:

the inner screw-race lips are generally parallel to one another; and the outer screw-race lips are generally parallel to one another.

20. The curtain-wall system of claim 13, wherein all of the inner screw-race lips and the outer screw-race lips are generally parallel to one another.

21. The curtain-wall system of claim 13, wherein the intermediate web section, the inner screw-race lips, and the outer screw-race lips form a generally H-shaped screw race.

22. The curtain-wall system of claim 13, wherein the inner screw-race lips and the outer screw-race lips are generally parallel to a direction of travel of the threaded fastener during progressive engagement of the threaded fastener with the curtain-wall mullion.

23. The curtain-wall system of claim 13, wherein a thickness of the intermediate web section is less than a thickness of the first leg and of the second leg.

24. A curtain-wall mounting method comprising:

penetrating, by a threaded fastener, of a pressure plate to be mounted relative to a curtain-wall mullion;

engaging, by the threaded fastener, of a pair of outer screw-race lips of the curtain-wall mullion; and engaging, by the threaded fastener, of a pair of inner screw-race lips of the curtain-wall mullion.

25. The curtain-wall mounting method of claim 24, comprising, prior to engaging the pair of outer screw-race lips, penetrating, by the threaded fastener, of a thermal insulator.

26. The curtain-wall mounting method of claim 24, comprising penetrating, by the threaded fastener, of an intermediate web section of the curtain-wall mullion.

27. The curtain-wall mounting method of claim 24, wherein the inner screw-race lips are generally parallel to one another.

28. The curtain-wall mounting method of claim 24, wherein the intermediate web section, the inner screw-race lips, and the outer screw-race lips form a generally H-shaped screw race.

29. The curtain-wall mounting method of claim 24, wherein the inner screw-race lips and the outer screw-race lips are generally parallel to a direction of travel of the threaded fastener during progressive engagement of the threaded fastener with the curtain-wall mullion.

* * * * *

UNITED STATES PATENT AND TRADEMARK OFFICE

CERTIFICATE OF CORRECTION

PATENT NO. : 7,823,346 B2
APPLICATION NO. : 11/675553
DATED : November 2, 2010
INVENTOR(S) : William J. Lang It is certified that error appears in the above-identified patent and that said Letters Patent is hereby corrected as shown below:

Title Page, Item (73) Assignee

Replace "Engineering" in Assignee Name to --Engineered-- so that Assignee name reads --Oldcastle Glass Engineered Products, Inc.--

Signed and Sealed this
Twenty-second Day of March, 2011

David J. Kappos

David J. Kappos
*Director of the United States Patent and Trademark Office*